US006120248A

United States Patent [19]

Litvin et al.

[11] Patent Number: 6,120,248

[45] Date of Patent: Sep. 19, 2000

[54] FAN CONSTRUCTION

[76] Inventors: Charles Litvin; William E. Lasko, both of c/o Lasko Metal Products, Inc. 820 Lincoln Ave., P.O. Box 891, West Chester, Pa. 19380-0294

[21] Appl. No.: 09/174,608

[22] Filed: Oct. 19, 1998

[51] Int. Cl.[7] ..... B63H 1/00; F04B 53/00

[52] U.S. Cl. ..... 416/63; 417/234; 416/247 R

[58] Field of Search ..... 416/63, 247 R; 417/234, 14

[56] References Cited

U.S. PATENT DOCUMENTS

| | | | |
|---|---|---|---|
| 2,755,015 | 7/1956 | Douglas et al. | 417/234 X |
| 2,950,859 | 8/1960 | Kirk | 417/234 X |
| 4,341,151 | 7/1982 | Sakamoto | 417/234 X |
| 4,521,153 | 6/1985 | Morimoto et al. | 415/146 |
| 5,110,263 | 5/1992 | Chiu | 416/244 R |
| 5,295,811 | 3/1994 | Chiu | 417/423.15 |
| 5,342,175 | 8/1994 | Patton | 416/247 R |
| 5,370,500 | 12/1994 | Thompson | 416/100 |
| 6,015,265 | 1/2000 | Lasko et al. | 416/247 R |

*Primary Examiner*—John E. Ryznic
*Attorney, Agent, or Firm*—Zachart T. Wobensmith, III

[57] ABSTRACT

Fan construction which includes a pre-assembled pretested handle assembly, which contains a multi-position switch, a thermostat, a cordset and wiring to connect to a fan motor, which is snapped into place in a fan body or grill.

4 Claims, 4 Drawing Sheets

FAN CONSTRUCTION

BACKGROUND OF THE INVENTION

1. Field of the Invention

This invention relates to fan construction of the type where the fans have open front and rear grills, with a pre-assembled handle assembly, which is snapped into place in the fan body or grill.

2. Description of the Prior Art

The marketplace for fans, particularly box and pivot fans which are sold at low cost, i.e., under $50.00 retail, is very large and extremely competitive.

A substantial portion of the cost of assembling these fans is labor. Fan assembly, while usually accomplished by unskilled labor, nevertheless is costly and labor intensive due to the large number of components required to assemble the fans, which fans must be tested for proper operation after assembly. Fan parts are not tested prior to assembly, except possibly by the manufacturer, and the discovery of defective, or damaged, or improperly assembled fans is not usually evident until after the fan is assembled. The cost of disassembling and replacing the defective or damaged part can consume the expected profit from the fan.

It is therefore a goal of the fan assembler or manufacturer to minimize problems, and to keep its labor costs as low as possible.

For example, in a typical prior art box fan, in order to assemble the handle and related parts to the fan body, the following steps are required:

insert ribbon cable into switch, insert ribbon cable into motor, add cordset to fan body and secure strain relief, insert cordset into switch, insert thermostat wire into switch, attach cordset wire to thermostat assembly wire with wirenut, snap thermostat assembly into fan body, snap switch into fan body, snap handle into fan body, attach thermoswitch knob to thermostat assembly, and attach switch knob to switch.

For another example, such as a typical prior art pivot fan, the steps required to assemble the handle to the fan rear grill follows the sequence described above for the box fan.

The number of individual parts required for assembly, and the number of steps to be followed by the assembler leaves considerable room for error. The finished product may also be subject to problems due to the environment into which it is placed by the ultimate consumer, and an improved design that better protects the fan components is desirable.

The fan construction of the invention requires a considerably less number of steps for assembly which is virtually goof proof, and provides an improved finished product.

SUMMARY OF THE INVENTION

Fan construction for box and pivot fans, where a pre-assembled handle assembly is provided which assembly is snapped into place in the fan body or grill of a box or pivot fan.

The principal object of the invention is to provide fan construction that is easy and economical to assemble. A further object of the invention is to provide fan construction which uses a pre-assembled handle assembly, which is installed in one direction.

A further object of the invention is to provide fan construction that is less subject to assembly errors and to defects in operation than previous fans.

A further object of the invention is to provide fan construction wherein the switch and thermostat are carried in the handle assembly.

A further object of the invention is to provide fan construction, wherein the handle assembly is pretested prior to assembly to the fan body or grill.

A further object of the invention is to provide fan construction that provides improved protection to fan components.

Other objects and advantageous features of the invention will be apparent from the description and claims.

DESCRIPTION OF THE DRAWINGS

The nature and characteristic features of the invention will be more readily understood from the following description taken in connection with the accompanying drawings in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Figure 1:
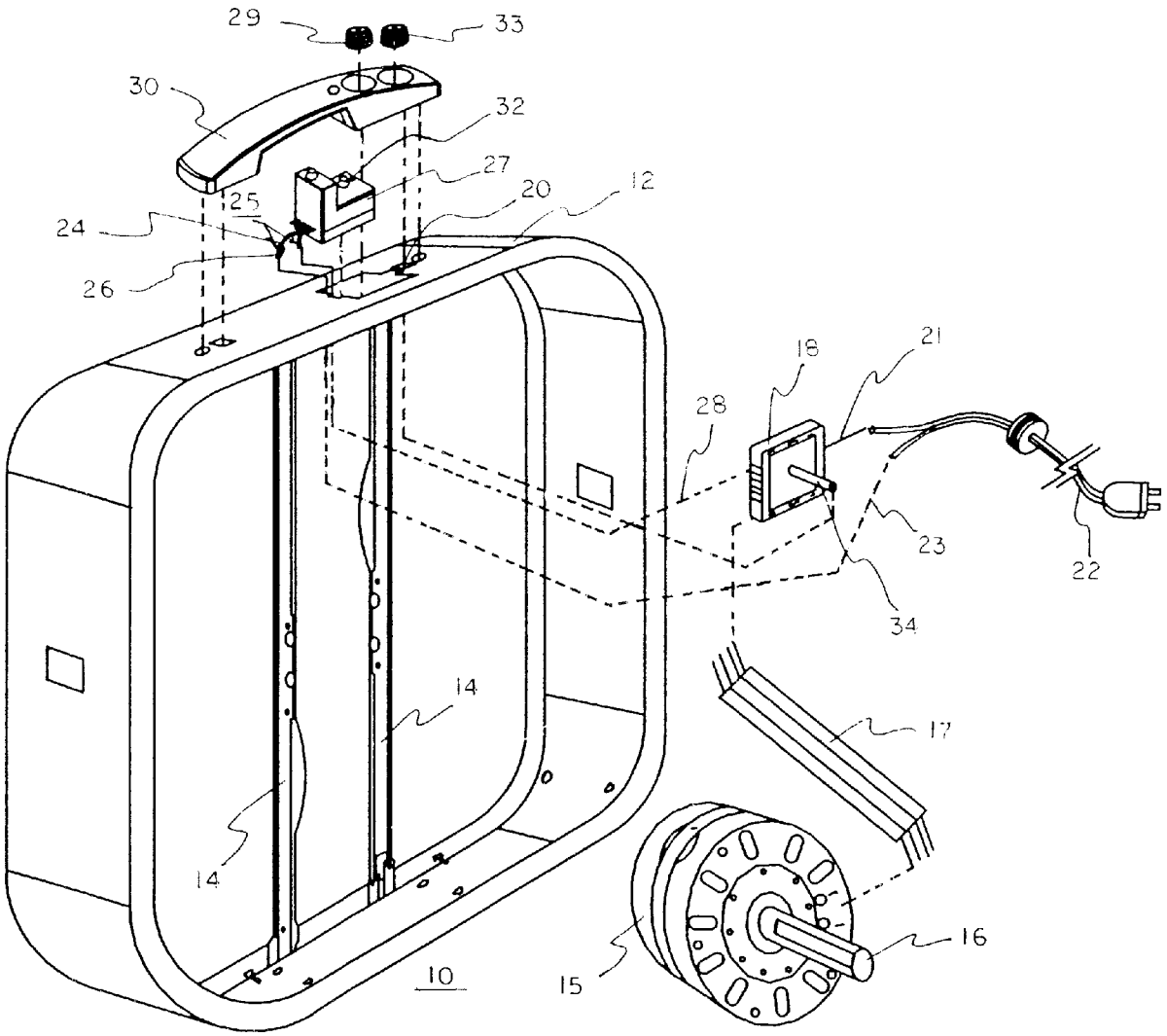
FIG. 1 is an exploded perspective view of one embodiment of a prior art box fan.

Referring now more particularly to FIG. 1 of the drawings, a typical prior art box fan 10 is therein illustrated.

The fan 10 includes a rear grill (not shown) and a front grill (not shown) which are attached in well known manner to a fan body 12 of rectangular configuration which is open at the front and back. The body 12, which is preferably of metal, has two vertically spaced ribs 14 attached thereto, preferably by welding. The assembly sequence of the fan components is as follows.

A fan motor 15 is provided, which extends between and is mounted to ribs 14 by bolts (not shown).

The fan motor 15 is provided with an output shaft 16 and has a ribbon cable 17 attached thereto, and to a multi-position switch 18, which switch 18 is engaged in an opening 20 in fan body 12.

The switch 18 has a lead 21 from a cordset 22 engaged therewith, and a lead 23 from cordset 22 engaged with lead 24 of a thermostat wire 25 by a wirenut 26. The lead 24 is engaged in a thermostat assembly 27, with another lead 28 from wire 25 engaged with switch 18.

A handle 30 is provided attached to fan body 12 by screws (not shown) engaged in bosses (not shown) in handle 30.

A thermostat knob 29 is engaged with a shaft 32 which extends from thermostat 27, and a switch knob 33 is engaged with a shaft 34 which extends from switch 18.

Figure 2:
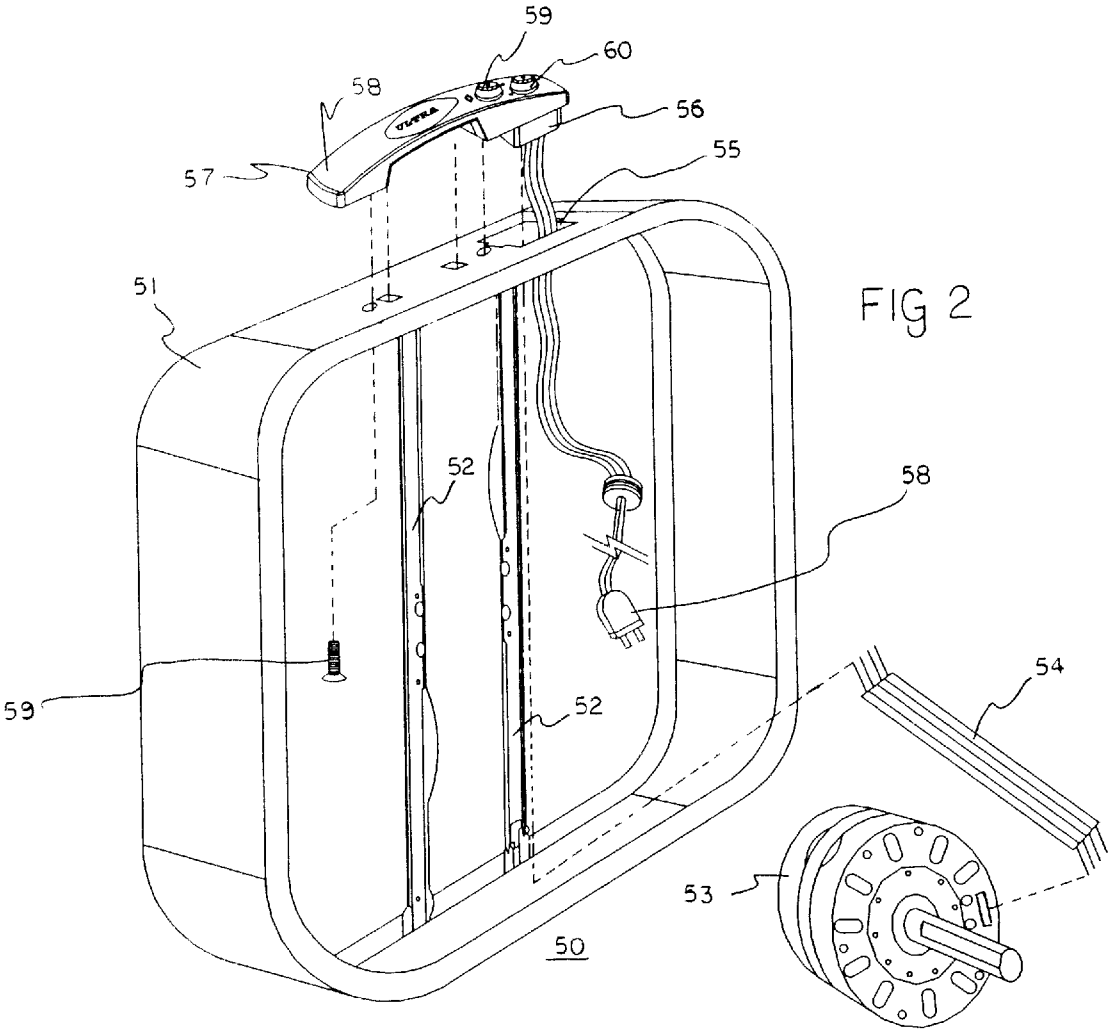
FIG. 2 is an exploded perspective view of one embodiment of the box fan of the invention.

Referring now to FIG. 2, a box fan 50 according to the invention, is illustrated, which has a fan body 51 which is similar to fan body 12.

The fan body 51 has two spaced vertically extending motor mounting ribs 52. For assembly a fan motor 53 is provided which extends therebetween and is mounted thereto by bolts (not shown). A ribbon cable 54 is engaged with motor 53, and extends through opening 55 in fan body 51 into engagement with a switch 56 in a handle assembly 57. A cordset 58 is provided which extends through hole (not shown) in body 51 and to a source of electrical power (not shown).

The handle assembly 57 includes a handle 58 with a thermostat (not shown) attached thereto which has a knob 59, and a switch 56 attached thereto with a knob 60. The switch 56 of handle 58 is passed through opening 55 and handle 58 is snapped into opening 55 and one screw 59 is engaged with fan body 51 and bosses (not shown) in handle 58. If desired, the ribbon cable 54 may be engaged with motor 53, after the handle assembly 57 is installed.

In the fan 50 of FIG. 2, the thermostat and switch are secured to and are part of the handle assembly 57, and are not separately assembled and retained in the fan body as they are in the prior art box fan of FIG. 1.

Figure 3:
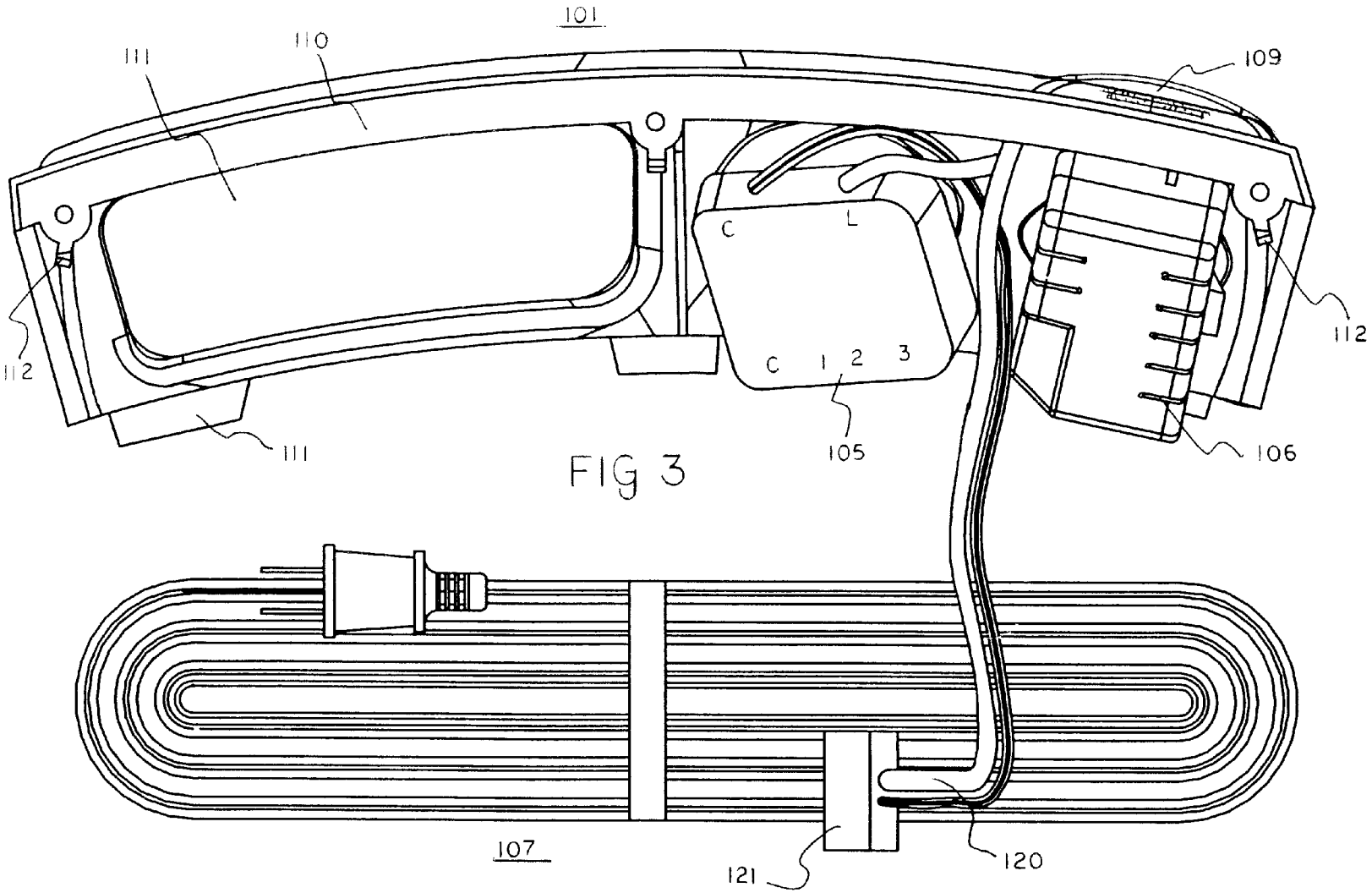
FIG. 3 is an exploded perspective view of another embodiment of pivot fan according to the invention.
Figure 4:
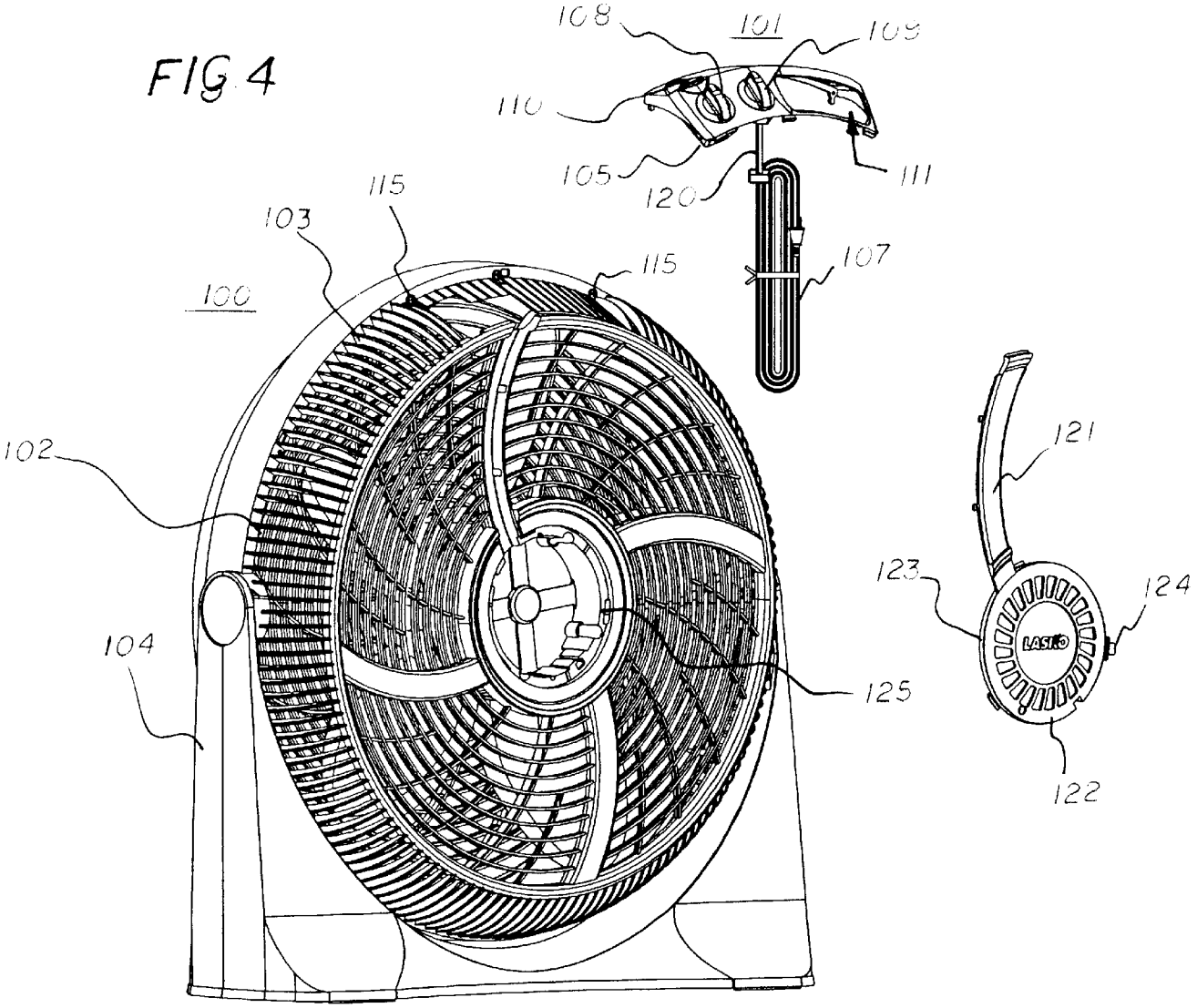
FIG. 4 is a side elevational view of another embodiment of the handle assembly for a pivot fan as illustrated in FIG. 3.

Referring now to FIGS. 3 and 4, a pivot fan 100 and a handle assembly 101 constructed according to the invention are therein illustrated. The fan 100 is shown with the pre-assembled handle assembly 101, a front grill 102, a rear grill 103 and a supporting yoke 104, which is attached to grill 103 in well known manner. The handle assembly 101 which is pretested prior to assembly has a thermostat box 105, a multi-position switch 106, internal connecting wiring (not shown) and a cordset 107 for engagement with a source of electrical power (not shown). The thermostat box 105 has a knob 108, and switch 106 has a knob 109.

The handle assembly 101 has a main body 110, with an opening 111 for insertion of the hand (not shown) of a user to position the fan 100.

The handle assembly main body 110 has tabs 111 and 112, which are engaged through opening 115 in rear grill 103, with the handle assembly 101 snapped into place in rear grill 103.

The handle assembly 101 has a ribbon cable 120, extending therefrom and retained in a raceway 121 of a cover 122, which cover includes a circular portion 123, which has tabs 124 which are engaged in openings 125 in rear grill 103, and which cable 120 has a plug 121, which is engaged with a fan motor (not shown).

It will thus be seen that fan construction has been described with which the objects of the invention are achieved.

I claim:

1. Fan construction where the fans have open front and rear grills, and/or an intermediate fan body, and a fan motor, the improvement which comprises a pre-assembled handle assembly for attachment to said rear grill, said handle assembly includes a handle, a thermostat and wiring means, said rear grill has an opening through which a portion of said handle extends, and attachment means engaged with said opening in said rear grill to fasten the handle assembly therein.

2. Fan construction as defined in claim 1 in which said fan body has at least one opening therethrough and said handle assembly is engaged in said opening.

3. Fan construction as defined in claim 1 in which said wiring means includes a cordset for attachment to a source of electrical power and a ribbon cable for attachment to said fan motor.

4. Fan construction as defined in claim 3 in which a cover is provided for attachment to said rear grill, and said cover has a raceway to receive and retain said ribbon cable for connection to said fan motor.

* * * * *